United States Patent [19]

Konieczynski

[11] 3,959,685

[45] May 25, 1976

[54] HEAT SINK TARGET

[76] Inventor: Ronald D. Konieczynski, 3947 Sprague Road, North Royalton, Ohio 44133

[22] Filed: Feb. 18, 1975

[21] Appl. No.: 550,845

[52] U.S. Cl. ..... 313/330; 313/60

[51] Int. Cl.[2] ..... H01J 35/08

[58] Field of Search ..... 313/330, 60

[56] References Cited

UNITED STATES PATENTS

| | | | |
|---|---|---|---|
| 3,711,736 | 1/1973 | Gabbay | 313/330 |
| 3,753,021 | 8/1973 | Braun | 313/330 |
| 3,795,832 | 3/1974 | Holland | 313/330 |
| 3,821,581 | 6/1974 | Holland et al. | 313/330 |
| 3,836,804 | 9/1974 | Frens et al. | 313/330 |
| 3,842,305 | 10/1974 | Braun | 313/330 |

*Primary Examiner*—Saxfield Chatmon, Jr.
*Attorney, Agent, or Firm*—Ronald R. Stanley

[57] ABSTRACT

A target for the anode of an X-ray tube is disclosed which greatly increases both the individual length of time which an X-ray tube may be operated and the total useful life of an X-ray tube. A conventional X-ray target is provided with one or more cavities within each of which a slug of material having a relatively low melting point with respect to the base of the target is encapsulated and sealed by means of a diffusion bonding method. The slug material is chosen so that heat which builds up when the target is operated causes the slug to melt and absorb large quantities of heat produced by the generation of X-rays so that the target as a whole is capable of sustaining a greater total heat input.

28 Claims, 9 Drawing Figures

HEAT SINK TARGET

BACKGROUND OF THE INVENTION

1. Field of the Invention

The use of X-rays in many fields for many purposes is almost common-place in the present day and age. One such use is in the field of medicine, wherein X-ray diagnosis and treatment is extremely important. Particularly where treatment is concerned, the use of X-ray generating equipment for extended periods of time is becoming more necessary.

X-ray generating equipment is fairly standard in construction. The main component is a generating tube. The major elements of this tube are a cathode, an anode with a target and a vacuum sealed glass, quartz or glasslike, enclosure. The cathode of the tube is similar to the filament in an ordinary light bulb. When energized, the cathode becomes heated and thus is caused to emit electrons. The electrons are attracted to the target which is part of the anode.

The anode includes the target which is generally a metal disc having a diameter of 3 to 5 inches and a thickness of ¼ of an inch to 1 inch. The target has an outer most radius which is angled slightly outward and thus the target as a whole has the appearance of a very shallow truncated cone. The center of the diameter of the target includes a aperture through which a stem is positioned and fastened. The stem is mounted in a bearing structure so that the target and stem are free to rotate. The stem is further provided with appropriate apparatus in order to operate as a rotor in an electric motor. The stator, which completes the electric motor, is external to the X-ray tube and is positioned directly around the stem and its attachments.

An electric field is present between the cathode and anode when the X-ray tube is operating. It is this electric field which causes the electrons from the cathode to be attracted to the anode as noted above. When the electrons strike the target of the anode, X-rays are emitted therefrom. As further noted above, the extreme outside radius of the target, from ½ inch to 1 inch, is angled outwardly. This is precisely the area in which the electrons from the cathode strike the target. Thus the emitted X-rays are caused to be directed away from the angled portion of the target and through the glass enclosure. At this point, the X-rays may be utilized in any fashion desired.

While a considerable quantity of X-rays are caused to be emitted from the target as a result of the electrons striking it, a larger quantity of electrons do not result in X-ray emission but rather are stopped by the target causing a heating thereof. The temperature at the spot, and the surrounding area, on the target at which electrons strike quickly rises. For exactly this reason the target is arranged to rotate as noted above at a speed of from 3,000 rpm to 9,000 rpm. The rotation has two purposes.

First, as the target rotates, a different spot is subject to the striking electrons at each instant in time. In this manner, the temperature of the entire target is raised equally. Since the target does rotate, no feasible way has been found to carry the build up of heat away from the target.

Second, while the target rotates, the particular areas which are not under bombardment by electrons from the cathode are given the opportunity to cool through radiant dissipation of the heat.

Even though some heat is dissipated through radiant energy, the heat build up in the target is continually greater than the amounts dissipated. In this respect, the temperature of the target increases to the range of 1000° to 1500°C at which time the tube must be shut down or permanent damage may be done. If the tube is allowed to overheat, the target, or more particularly the bearings of the stem, may be rendered inoperative permanently.

2. Prior Art

For many applications of X-ray generation, and in particular the medical field, extending the time for which the tube may be used would be extremely advantageous. Therefore, manufacturers of X-ray equipment have endeavored to design systems which can operate for prolonged periods.

In this regard, the target in an X-ray tube was, at one time, constructed totally of a material which would emit X-radiation upon bombardment by electrons, i.e., tungsten or tungsten alloy. However, through experimentation it was discovered that such a target did not, in fact, display optimum thermal characteristics.

In an effort to increase heat absorption, a "layered" target was devised. This type of target included only a thin layer of X-ray generating material, i.e., tungsten alloy, while having the remainder of the target constructed of a material with a much higher specific heat, e.g., molybdenum or molybdenum alloy.

Due to the fact that the improved target with the X-ray generating layer is composed of layers of different materials and the different materials may be differently effected by heat, warping of the target was often the next problem encountered. To this effect, a solution to the problem of warping targets was sought after. U.S. Pat. No. 3,790,838 discloses one such solution in the way of a "warpless" target.

Another method utilized to effect increased efficiency of X-ray targets and thus tubes is the use of nonmetallic materials in the targets. The use of such nonmetallic materials, e.g., carbon, may appear in the form of a backing for the target or an integral portion thereof. An example of the latter is disclosed by U.S. Pat. No. 3,753,021. This particular patent has an outer conventional target ring of molybdenum or other suitable material and an inner heat sink ring, or ring segments, arranged to be in very close, tight proximity with the target ring. The heat sink ring is constructed of a material capable of storing large quantities of heat for extended periods and may be a material such as graphite or beryllia.

As mentioned above, additional problems arise when differing materials are utilized in a target due to the different reactions from extreme heat exposure. In this respect, the advantage of the last mentioned patent is derived from the ability of the heat build-up in the target material to be transfered to the heat sink material through a close, tight proximity contact. However, this close, tight proximity contact may in fact be less than intended due to different expansion rates of the materials. To some extent, the effects of this problem may be cancelled by other construction techniques such as segmenting the heat sink. Again, while the use of nonmetallic materials in a target increases the usefulness to some extent, the emphasis is to ever increase the effectiveness of the equipment.

SUMMARY OF THE INVENTION

The primary object of this invention is to provide a new and improved X-radiation generating tube capable of extending the operating time of X-ray equipment.

Further objects of this invention are to provide a new and improved X-ray tube including a target which is capable of sustaining extremely high operating temperatures, which resists the flow of heat towards the bearings of the anode of the tube, which is not significantly adversely effected by differing reactions to heat build-up by different target components and which is not susceptible to component separation due to extreme heat build up.

Another object of this invention is to provide a new and improved X-ray tube having a target which utilizes the differing expansion rates due to heat build-up of component materials of the target to advantage in the construction of an improved target.

Still other objects of this invention are to provide a new and improved X-ray tube including a target which dissipates the heat build-up at an increased rate, and which utilizes the heat of fusion of a component material to increase efficiency of operation.

An even further object of this invention is to provide a new and improved X-ray tube which utilizes a preexisting target modified to included the particularities of this invention.

A still further object of this invention is to provide a new and improved X-ray tube which utilizes an entirely unique target having integral therewith the components embodying the particularities of this invention.

A further object of this invention is to provide a new and improved X-ray tube which obtains one or more of the objects and advantages set forth above.

These and other objects and advantages of this invention will become apparent from the following description thereof, in view of the accompanying drawings.

DETAILED DESCRIPTION OF THE PREFERRED EMBODIMENT

Figure 1:
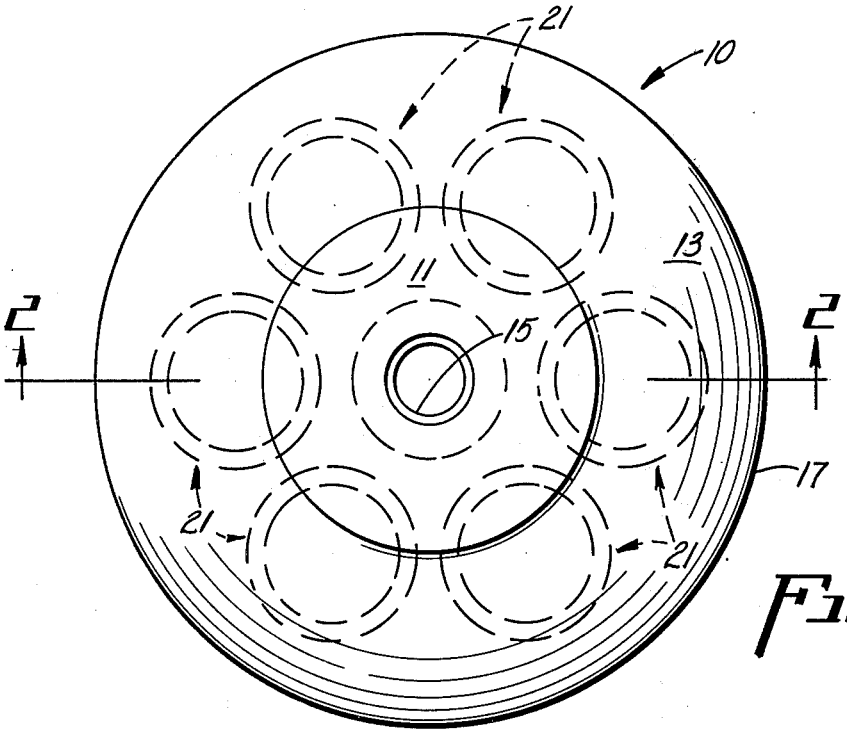
FIG. 1 is a plan view of a target for X-radiation including one specific construction of the particularities of the present invention.

The present invention is an apparatus and method of construction for an X-ray target having a much improved capacity for heat absorption and dissipation.

The operating temperature for X-ray tubes is generally in the range of from 1000° to 1500° Centigrade.

For this reason materials having melting temperatures below or within this range were not, in the past, utilized in the construction of such targets. Obviously, if such a material were used and melting resulted, permanent damage to the tube would be the end result.

Heat of fusion or latent heat of fusion are descriptive terms for a known physical principle describing the characteristics which occur when a solid melts into a liquid, or alternately when a liquid changes phase upon returning to a solid. More particularly, at the precise temperature at which a solid reaches its melting point, a quantity of heat is absorbed merely due to the change in phase. The same is the case upon going from a liquid to a solid, except that the heat is dissipated in this case.

By constructing a target for X-ray tubes, incorporating this principle of heat of fusion, a considerable increase in heat absorption results. In this regard an X-ray target is designed which contains, sealed within the conventional target, a material which purposely melts at or near the maximum operating temperature of the tube and target. As this target operates, the temperature will rise much as in the case of an ordinary target.

It should be understood that due to the presence of materials of a higher specific heat, there exists more heat absorption capability in a target designed as in this invention than in a target of conventional design having exactly the same total weight. For this reason, the temperature of the target will rise slower for a target of the proposed design than that of a conventional target.

At or near the maximum recommended operating temperature of the proposed target, the higher specific heat material sealed within the target melts. At this precise instant, still more heat can be absorbed due to the heat of fusion at phase change. Since the heat of fusion absorbs heat without any rise in the temperature of the target, the length of time for which the tube and target can be operated is increased. In effect the time in which the target reaches its maximum operating temperature is lengthened.

Once the target has reached the maximum temperature, it must be shut-down, i.e., X-ray generation ceases, and cooled. The presence of the high specific heat material again aids in this regard. As the target begins to cool, at the precise instant that the high specific heat material solidifies again, a quantity of heat is dissipated merely due to the phase change.

The rate at which the target cools by means of radiation has been found to be proportional to the temperature difference between the surfaces which are exchanging radiation, each having an individual temperature, and each raised to the fourth power. This is a well known principle, more precisely exhibited by the following formula:

$$Q = K[T_1^4 - T_2^4]$$

where $Q$ is the rate of heat flow, $K$ is a constant dependent upon a number of conditions, such as surface roughness and emissivity, $T_1$ is the temperature of the target, and $T_2$ is the temperature of the surface with which the exchange is taking place.

Through an analysis of the above formula and the principle upon which it is based, an extraction may be made as to the maximum rate of heat loss. This extraction may be stated as being the greatest resulting loss of heat occurs when the target is hotest. In this regard, the temperature of the high specific heat material stays relatively high until the same material resolidifies. At this point in time, all the heat which was initially required to cause the phase change from solid to liquid is dissipated when the liquid changes to a solid. This increment of heat is radiated, or in fact dissipated, at the fastest possible rate.

From this point on, each additional increment of heat loss is accompanied by a reduction in temperature of the target. Each subsequent increment of heat loss is therefore slower. Finally, when the temperature of the target becomes close to that of the tube, the rate of heat loss is infinitesimal.

FIG. 1 illustrates an initially conventional target for an X-ray tube which has been modified to include the provisions of this invention. A target, indicated generally at 10, is shaped as noted above, like a shallow truncated cone. Thus a first portion 11 of a first surface is generally parallel with a second surface (not shown in FIGS. 1, 12 in FIG. 2) while a second portion 13 of the first surface is angled toward the extreme radius of the target. The center of the target 10 has an aperture 15 which is intended to be utilized to mount the target to a stem (not shown in the figures) and thus onto the anode of an X-ray tube (also not shown in the figures) as described above.

Figure 2:
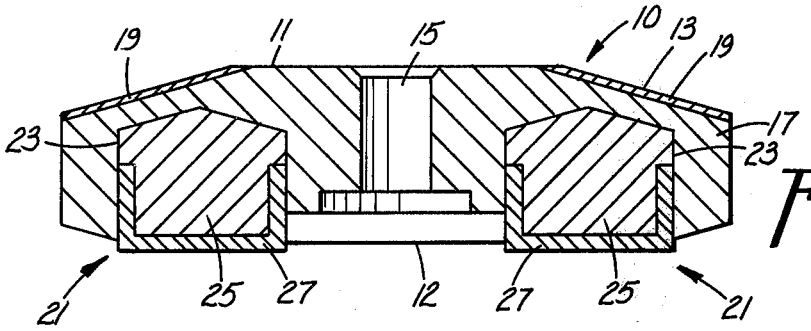
FIG. 2 is a cross-sectional view of a target embodying this invention, taken along line 2—2 of FIG. 1.

FIG. 2 further illustrates the construction of the target 10 of FIG. 1. A base 17 of the target is constructed of any suitably high heat absorbing material such as molybdenum or a molybdenum alloy. As further explained above, a relatively thin layer of X-ray generating material 19 is permanently fixed to the second portion 13 of the target 10. One such material which may be utilized for X-ray generating material 19 is tungsten rhenium.

The particularities of the present invention are incorporated into the target 10 of FIGS. 1 and 2 through the addition of a number of capsules of material, indicated generally at 21, having a high specific heat as discussed in detail above. In this instance six such capsules are used.

A cavity 23 for each capsule 21 is provided in the base 17. These cavities 23 may be machined in the base 17, as would be the case in the event that a pre-existing target were to be modified, or provided by any other suitable method. Within each cavity 23 is positioned a filler material 25 which is in solid form in this case. Since it is expected that the filler material 25 may expand, upon heating, at a greater rate than the base 17 as noted above, the filler material 25 may be initially constructed to be of smaller dimensions than the cavities 23.

As more thoroughly discussed above, the filler material 25 is of a type which displays a high specific heat while being capable of melting into a liquid state just prior to the maximum operating temperature of the target 10. Through experimentation, copper or copper alloys have been found to be exceptionally good materials for use as the filler material. In this regard, liquid copper does not display any adverse effects on the base structure which is generally constructed of molybdenum or a molybdenum alloy, e.g., does not fuse therewith.

Another possibility for the filler material is silicon. However, silicon alone has a melting temperature which may exceed the intended maximum operating temperature of the target as now constructed. For this reason, silicon may have to be alloyed with other materials in order to be utilized.

Once the filler material 25 has been inserted into each cavity 23, the base 17 must be sealed in order that the filler material, upon melting, is not able to run freely in the tube. For this reason, a cap 27 is inserted into each cavity causing the filler material 25 to be encapsulated, in the base 17. The cap 27 is designed to be a tight fit to the cavity 23. The cap 27 is preferably constructed of a high melting point material, compatible with the base 17, such as tantalum.

Figure 3:
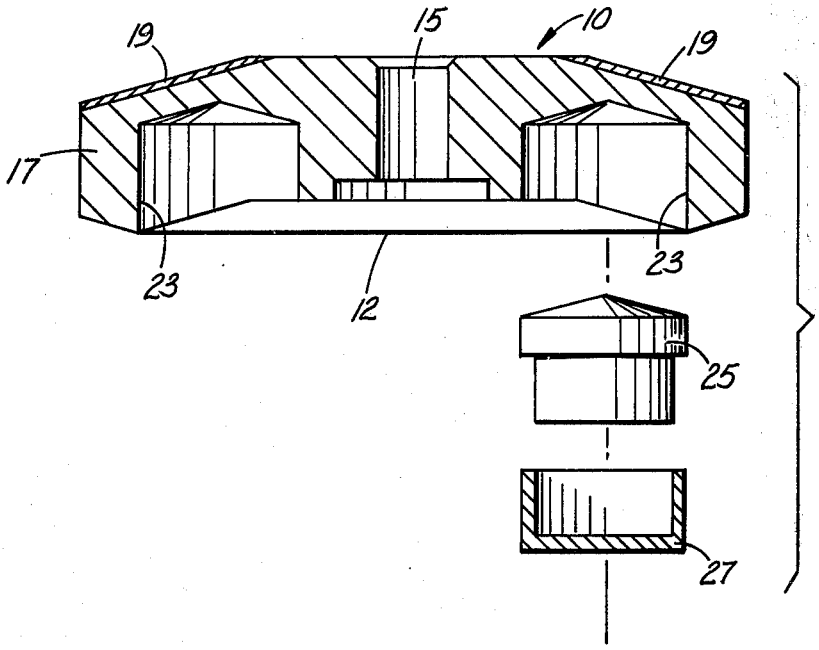
FIG. 3 is an exploded view of the components of a target embodying this invention.

FIG. 3 illustrates the target 10 of this invention in a manner more clearly indicating the individual components of the invention and their assembly. Although only one filler material 25 and cap 27 is shown, the components and assembly would be identical for each of the six cavities 23 shown in FIG. 1.

In order that the filler material not be capable of exiting from the target when it has reached its liquid state, each cap 27 must be permanently sealed to the base 17. This sealing may be achieved in any of a number of ways, e.g., brazing, welding, etc. The present invention includes a method of sealing the filler material within the target which, while not being unique in the physical principles thereof, offers a new and unique solution to the particular situation presented by this target construction.

Once the target 10 has been assembled as described above including the cap 27 being tightly fit into each cavity 23, the target 10 is heated to its intended high temperature just below the melting temperature of the filler material through any suitable means such as a furnace. As the temperature rises, the principle of diffusion bonding causes a sealing of the cap 27 and base 17. As noted above, the materials of which the base 17 and each cap 27 are constructed are chosen to be compatible. For this reason, at an appropraite temperature range, i.e., 1000°C, the material of the base 17 and the material of the caps 27 actually form a molecular bond through diffusion of the individual particles thereof. It should be noted, that at this temperature, copper is not melted and therefore can not adversely effect the bonding of the base of the caps.

Since many filler materials can be expected to expand more than the base material upon heating, a pressure will be made to occur from within each cavity as the temperature rises. This pressure can assist the sealing of the cap to the base by forcing each cap more tightly against the wall of each cavity. Thus a complete, thorough seal can be expected.

In experimentation, a target was actually constructed in accordance with the objects and details of this invention. A commercially available, layered target having a diameter of three inches was obtained. The X-ray generating layer was made of tungsten rhenium alloy and was approximately 0.040 inch thick. The base was made of molybdenum approximately 0.500 inch thick.

Six cavities 0.750 inch in diameter and approximately 0.400 inch deep were machined into the surface of the target most remote from the tungsten rhenium layer, i.e., second surface 12. A slug of commerically pure, oxygen free copper, machined to be just under the size of the cavity, was inserted into each cavity. The copper so chosen melts at 1083° Centigrade which temperature is very close to the intended maximum operating temperature of the target.

To the back of each such slug of copper was fitted a tantalum cap which is approximately 0.090 inch thick. In this case, the tantalum caps were zirconium brazed to the base in a furnace, in a vacuum at 1700° Centigrade.

The initial, unmodified and final modified weights of the target were recorded and compared to assure that there would be no significant change in target weight due to the addition of the copper heat sinks.

This particular design of target exhibited a calculated, additional heat capacity of approximately twenty percent over a conventional, unmodified target of the exact weight and size at an operating temperature of 1100° Centigrade.

One problem which may arise in the construction of a target as disclosed herein, is internal pressure caused by gasses trapped within the cavities when the target is assembled. If the target were heated in order to seal with such gasses present, complications could arise. For this reason, the assembled target is outgassed before sealing. This process solves the gas problem efficiently with the exception of gasses which might be present between the filler material and the caps.

Figure 4:
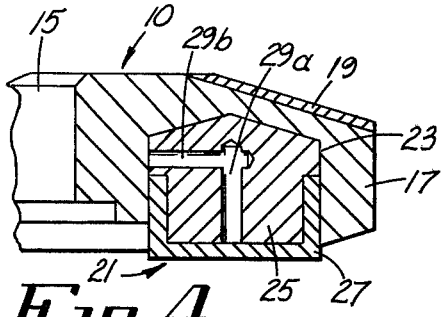
FIG. 4 is a partial section of a target showing specific adaption of the invention.

FIG. 4 illustrates one possible means of assuring the expulsion of gasses from between the filler material 25 and the cap 27. In this instance, apertures 29*a* and 29*b* are provided, as by drilling, in the filler material 25. The apertures 29*a* and *b* are positioned so that they intersect and thus provide a free path for gasses from the inside of the cap 27 to the outside of the target. Although two apertures are shown, it is easily understood that one aperture, diagonally across the filler material would provide identical advantages. Moreover, other suitable methods might be utilized to remove internal gasses without obviating the invention in this case.

Many alternate designs of the target 10 may be visualized. For instance, more cavities may be utilized, fewer cavities may be utilized, larger cavities may be utilized, etc. Each such variation can be expected to portray differing heat absorption characteristics.

Figure 6:
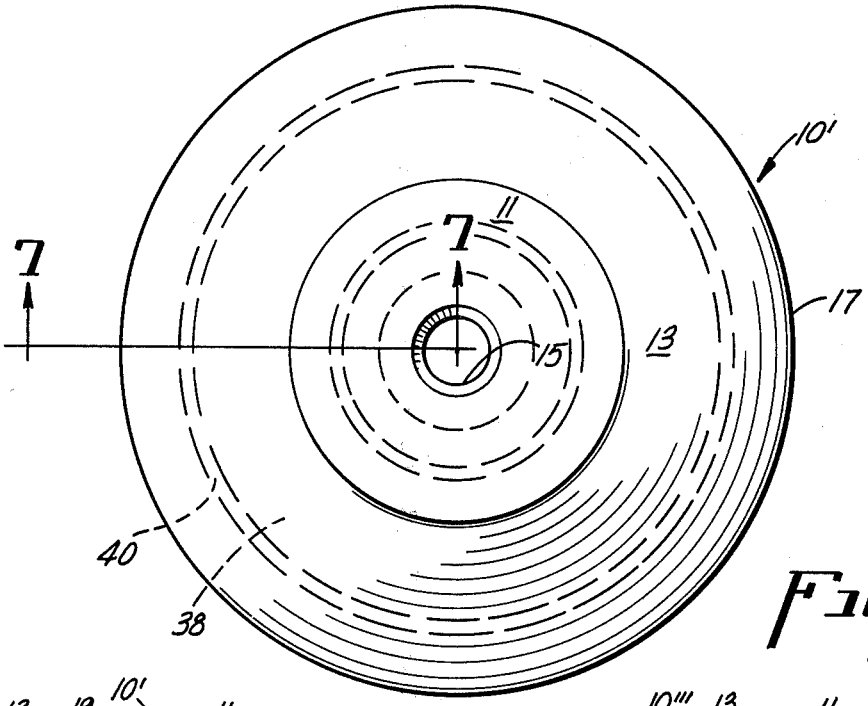
FIG. 6 is a plan view of a target for X-radiation including another specific construction of the particularities of the present invention.

Expanding upon the principles of this invention, logic would seem to dictate that the larger the mass of filler material, the greater would be the heat absorption capabilities. In line with this view, FIG. 6 illustrates a target 10′ evidencing an attempt to maximize the filler mass.

Figure 7:
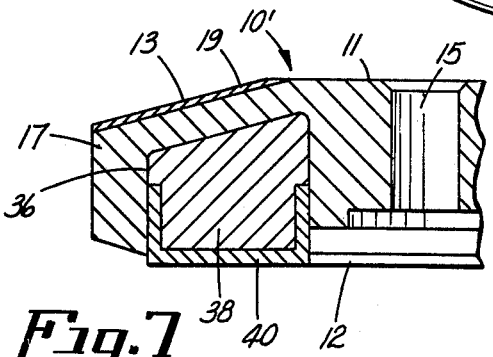
FIG. 7 is a cross-sectional view of a target embodying this invention, taken along line 7—7 of FIG. 6.

The target 10′ is much the same as in the case of a conventional target. The base 17, preferably of molybdenum or a molybdenum alloy, has the first portion 11 of the first surface and the angled second portion 13 with the aperture 15 in the middle thereof. FIG. 7 further illustrates the details of the target 10′ such as the layer of X-ray generating material 19.

In this case, however, a single cavity 36 is provided in the base 17 by any suitable means such as machining or forging. The cavity 36 is annular in shape and extends around the entire base 17 being spaced between the aperture 15 and the most extreme radius of the base 17. An annular filler material slug 38 is inserted into the cavity 36. Finally, an annular cap 40 is positioned over the annular filler slug 38 and within the cavity 36.

The remainder of the procedure for constructing the target 10′ is unchanged from that explained in detail above. The cavity 36 is outgassed and the annular cap 40 sealed to the base 17. Also the apertures 29*a* and *b* as described above (FIG. 4) may be incorporated into the annular filler material 38 in order to assist outgassing.

Figure 5:
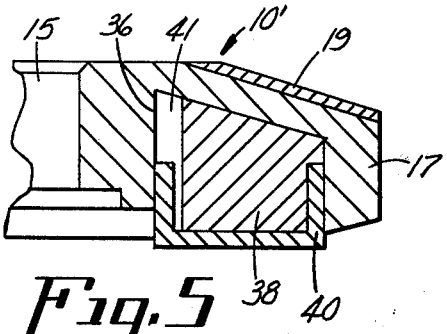
FIG. 5 is a partial section of a target showing a specific adaption of the invention.

As stated previously herein, with respect to general objects of X-ray tube manufactures, one desire in extending the working time of an X-ray tube involves restricting as much heat as possible from conduction to the bearings of the anode and target. The present invention is capable of deriving an additional benefit in this regard. FIG. 5 shows a portion of a target as described above. In this instance, a void 41 is provided adjacent to the filler material 38 in the base 17 of the target 10′.

The filler material 38 is designed so that the inner most radius is considerably smaller than the cavity 36. It should be noted that the void 41 may be of any size and/or shape desired and no novelty is considered to be connected with these particular characteristics. When the cavity 36 is outgassed as described above, the void 41 is also outgassed.

It may be understood that while the filler material 38 is in a solid state the void 41 is effectively a vacuum. Likewise, when the filler material 38 changes into a liquid due to heat absorption, since the target is rotating at a considerable speed, the centrifugal force causes the melted filler material to be concentrated at the most extreme radii possible thus maintaining an effective vacuum in the void 41.

Understandably, heat is conducted more easily through adjacent contacting surfaces. This principle is shown by the above noted U.S. Pat. No. 3,753,021. For this reason, the trasfer of heat by conduction towards the center of the target 10′ and thus the bearings are restricted to a large extent because the path for conduction of heat must be around the void 41 instead of through it.

Figure 8:
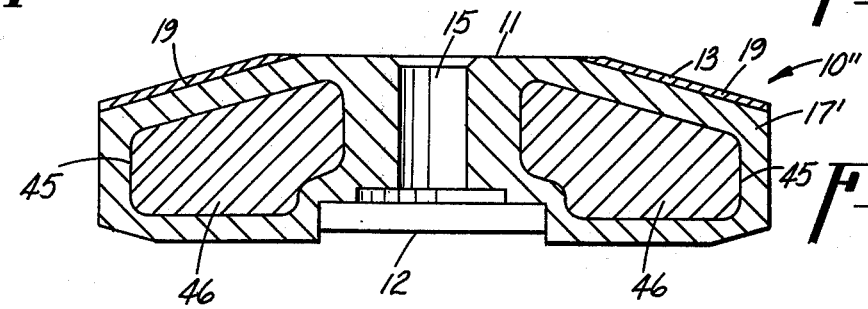
FIG. 8 is a cross-sectional view of a target embodying another specific construction of this invention.

FIG. 8 illustrates yet another attempt at maximizing the filler mass in an X-ray target utilizing the particulars of this invention. A target 10″ having a base 17′ constructed of any suitable material such as molybdenum has the aperture 15 at its center and the layer of X-ray generating material 19 as described before.

In this case, the base 17′ has integrally cast therein a cavity 45 which is annular in shape. An opening (not shown) to the exterior of the target 10″ would be provided, preferably in the first portion 11 of the first surface of target 10″. Through this opening, a filler material 46, such as copper or silicon alloy, would be inserted into the cavity 45. Due to the size of the opening, preferably quite small, the filler material 46 would be required to be in a liquid state when inserted into the cavity 46.

Once the filler material 46 has been inserted into the cavity 45, the cavity should be outgassed and the opening permanently closed by inserting a tight fitting plug (not shown) and sealed, as previously described, e.g., brazing, welding or diffusion bonding. In this case, the void 31 as discussed above may be provided for by purposely inserting considerably less filler material 46 than is necessary to fill the cavity 45. Again, the void 31 will automatically be positioned at the inside radius of the cavity through centrifugal force when and if the target 10″ is caused to rotate.

Figure 9:
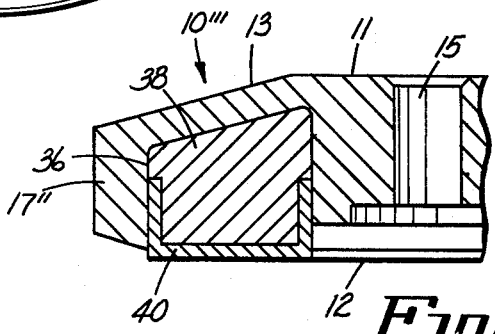
FIG. 9 is a cross-sectional view of another target embodying a specific construction of this invention.

FIG. 9 illustrates a construction for a target 10‴ made parctical only by the present invention. The target 10‴ has the first portion 11 of the first surface, the second portion 13 of the first surface and the second surface 12 as in the case of the previously explained targets. However, there is no layer of X-ray generating material. Instead an entire base structure 17″ is constructed of X-ray generating material, i.e., tungsten alloy. Due to the low heat absorption characteristics of this type of material, such a construction was not deemed feasible in the past except for those applications where less heat absorption could be tolerated.

In this case, the principles of this invention are applied by including the annular cavity 36 integral within the base 17''. As before, the annular filler material 38 is inserted into the cavity 36 and the annular cap 40, of a suitable material compatible with the material of base 17'' is assembled over the filler material. The procedure thereafter is identical to the above disclosure. The void 41 may also be utilized as above, in the target 10''' of FIG. 9.

Calculations indicate that modifications of most commerically available targets having diameters of from 3 to 4 inches in accordance with the principles of this invention should increase heat capacity by 20 to 50 percent. The same calculations indicate that a specially designed target, utilizing the maximum amount of a silicon alloy filler, without exceeding the weight of present targets, but operating at a somewhat higher maximum temperature, should be capable of doubling the heat capacity of present targets.

Modifications, changes and improvements to the preferred forms of the invention herein disclosed, described and illustrated may occur to those skilled in the art who come to understand the principles and precepts thereof. Accordingly, the scope of the patent to be issued hereon should not be limited to the particular embodiments of the invention set forth herein, but rather should be limited by the advance by which the invention has promoted the art.

What is claimed is:

1. In an X-ray target designed to be rotated on a central axis while causing X-rays to be directed from a finite plurality of angular intervals throughout a surface of the target, an improvement in the target comprising a base structure of extremely high melting point material, at least one cavity in said base structure, encapsulating means for each said cavity constructed of a high melting point material compatible with that of said base structure and filler means for each said cavity having a melting point substantially near a maximum operating temperature of the X-ray target permanently encapsulated by said base structure and said encapsulating means.

2. An X-ray target according to claim 1 in which there is only one cavity, one encapsulating means and one filler means.

3. An X-ray target according to claim 2 in which said cavity is annular in shape.

4. An X-ray target according to claim 1 in which said filler means is initially a liquid when encapsulated which hardens to a solid.

5. An X-ray target according to claim 1 in which said base structure is a molybdenum alloy and said encapsulating means is tantalun.

6. An X-ray target according to claim 5 in which an X-ray generating layer is permanently positioned on the surface of said target.

7. An X-ray target according to claim 1 in which said base structure is a tungsten alloy.

8. An X-ray target according to claim 1 in which said filler means is copper.

9. An X-ray target according to claim 1 in which said filler means has a melting temperature of approximately 1100°C while the maximum operating temperature of the X-ray target is equal to or slightly greater than 1100°C, whereby heat of fusion of the filler means is utilized to increase the efficiency of the target.

10. In an X-ray tube having an anode with a rotationally mounted target causing X-rays to be directed from a finite plurality of angular intervals throughout a first surface of the target, an improvement in the target comprising a base structure of extremely high melting point material, an X-ray generating layer permanently positioned on said base structure on the said first surface, at least one cavity in a second surface of the base structure, a cap means for each said cavity for forming an enclosed capsule between the base structure and each said cap means, each said cap means constructed of an extremely high melting point material compatible with that of said base structure, and filler means for each said cavity permanently encapsulated by said cap means and said base structure, said filler means having a melting point substantially near a maximum operating temperature of the target.

11. The target according to claim 10 in which said filler means has a melting temperature of approximately 1100°C while the maximum operating temperature of the target is equal to or slightly greater than 1100°C, whereby the heat of fusion of the filler means is utilized to increase the efficiency of the target.

12. The target according to claim 10 in which there is only one cavity, one encapsulting means and one filler means.

13. The target according to claim 10 in which said base structure is a molybdenum alloy, said encapsulating means is tantalum and said filler means is copper.

14. The target according to claim 10 in which said filler means is inserted in solid form and encapsulated by said base structure and said encapsulating means.

15. The target according to claim 14 in which said filler means is provided with at least one aperture therein for releasing gases from within.

16. The target according to claim 12 in which said filler means is substantially smaller than said cavity so that a void results within said cavity.

17. The target according to claim 16 in which said void is arranged to be toward the smallest radii of said base filler means.

18. The method of producing an improved target for an X-ray anode comprising constructing a base structure of high temperature alloy material, providing a central bearing surface in said base structure for rotating the target, providing at least one cavity within the base structure, inserting filler means having a melting point substantially identical to a maximum operating temperature of the target into each said cavity, assembling an encapsulating means for each said cavity, and permanently sealing each said cavity by raising the temperature of the target until said encapsulating means is permanently bonded to the base structure.

19. The method according to claim 18 further comprising utilizing the heat of fusion of the filler means to produce a target having a relatively sustained efficiency under high heat conditions.

20. The method according to claim 18 further comprising utilizing only one cavity within said base structure.

21. The method according to claim 18 further comprising utilizing a molybdenum alloy for the base structure and copper for the filler means.

22. The method according to claim 21 further comprising permanently attaching a thin layer of X-ray generating material to a first surface of said base structure.

23. The method according to claim 18 further comprising rotating said target while sealing each said cavity whereby the filler means is centrifugally arranged to be concentrated radially outward within the base structure.

24. The method according to claim 18 further comprising utilizing an annular shaped filler means.

25. The method according to claim 18 further comprising providing solid filler means.

26. The method according to claim 18 further comprising designing the filler means so that said filler means is smaller than said cavity whereby a void is produced in said cavity upon fusing said base structure and encapsulating means.

27. The method according to claim 25 further comprising drilling at least one aperture in each said filler means whereby gases from within the said cavity can escape from within.

28. The method according to claim 18 further comprising the filler means causing extensive pressure to be applied upon the encapsulating means against the base structure, said pressure assisting the fusing of the encapsulating means and said base structure.

* * * * *